United States Patent [19]

Ramstrom et al.

[11] 4,329,757

[45] May 18, 1982

[54] HEADLIGHT CAP WIRING HARNESS AND SWITCH

[75] Inventors: Lee W. Ramstrom, North Olmsted; Raymond Strnad, Avon Lake, both of Ohio

[73] Assignee: The Scott & Fetzer Company, Lakewood, Ohio

[21] Appl. No.: 209,132

[22] Filed: Nov. 21, 1980

[51] Int. Cl.[3] ..... A47L 9/30

[52] U.S. Cl. ..... 15/324; 15/332; 15/339

[58] Field of Search ..... 15/324, 332, 334, 339

[56] References Cited

U.S. PATENT DOCUMENTS

| | | | |
|---|---|---|---|
| 2,072,690 | 3/1937 | Smellie | 15/314 X |
| 2,322,223 | 6/1943 | Coss | 15/332 |
| 3,319,282 | 5/1967 | MacFarland | 15/319 |
| 3,444,582 | 5/1969 | Erbor | 15/324 |
| 3,467,980 | 9/1969 | Golloway | 15/332 X |

*Primary Examiner*—Chris K. Moore

*Attorney, Agent, or Firm*—Pearne, Gordon, Sessions, McCoy & Granger

[57] ABSTRACT

There is disclosed a suction cleaner having a motor, a body portion housing the motor, and interengageable attachments adapted to be attached to the body portion for cleaning operations requiring different motor speeds. A safety switch is provided within a headlight shroud. Attaching elements are provided on each attachment so that the attachment may be affixed to the body portion of the cleaner. The attaching members are covered by the headlight shroud and are exposed by the shroud when the shroud is pivoted to an open position. The safety switch has a first switch position which disconnects the motor from an electrical circuit and a second switch position which causes the motor to run at a relatively slow speed and a third switch position which causes the motor to run at a relatively high speed. Each attachment is provided with a pin which actuates the safety switch to run at either a high speed for off-the-floor cleaning operations or a low speed for on-the-floor cleaning operations. There is further provided a headlight mount which is removably attached to the headlight shroud and which has a connect-disconnect relationship with the terminal block so that the headlight mount is electrically disconnected when it is necessary to change a bulb.

8 Claims, 9 Drawing Figures

HEADLIGHT CAP WIRING HARNESS AND SWITCH

BACKGROUND OF THE INVENTION

This invention relates to suction cleaners and, more particularly, to a safety switch for suction cleaners that automatically varies the speed of the suction cleaner motor in response to different types of attachments that are removably fixed to the body of the cleaner.

Many conventional suction cleaners employ a two-speed motor which is controlled by a manually operated switch. For cleaning rugs and carpets, a low speed is desired, since the carpet pile or rug tends to block the suction end of the cleaner and may cause a high speed motor to run hot because of the increased load on the fan. Moreover, if the beater brush is operated at a high speed on a carpet or rug, the suction cleaner wears the carpet pile too fast and the cleaner is difficult to push. A high speed is desirable in applications where dusting attachments are connected to the sweeper, since the ends of these attachments are spaced a considerable distance from the suction fan and a pressure drop occurs along the length of the hose from the dusting nozzle to the sweeper body.

Frequently, the operator becomes confused as to the particular speed recommended for a particular attachment, particularly in view of the variety of attachments being offered by vacuum cleaner manufacturers. Suction cleaners have been designed, therefore, to include switches which are responsive to a particular attachment. For example, in a patent to Smellie U.S. Pat. No. 2,072,690, there is disclosed a suction cleaner having a two-speed motor which is operated in response to a switch. The switch in turn is a two-position switch which is actuated to its first position only in response to a dusting attachment to thereby run the motor at a relatively high speed, and is actuated to its second position only in response to a carpet cleaning nozzle to thereby run the motor at a relatively low speed. Prior art switches of the type shown in the Smellie patent control the motor speed by a field tap arrangement. One position of such a switch cuts out a portion of the field winding of the motor to permit the motor to run at a higher speed because of the decreased field resistance. The other position of the switch connects the line across the entire field winding to reduce the motor speed because of the increased field resistance.

The conventional switches have met with limited commercial success because of the expense involved in field tap wiring systems. A far simpler wiring arrangement for controlling the speed of a motor is to provide a switch that will connect the field windings in series for low speed operations and that will connect the field windings in parallel for high speed operations. Such a wiring arrangement in its simplest form, however, has not been employed since the field windings are short-circuited and the current is applied directly through the armature if the high speed and low speed switches are intentionally or inadvertently closed at the same time.

To overcome that problem, it has been proposed in U.S. Pat. No. 3,319,282 to employ a simple wiring arrangement and switch that will alternately connect the field windings of a motor in series for low speed cleaning operations in response to low speed cleaning attachments and which will connect the field windings in parallel for high speed cleaning operations in response to the provision of high speed cleaning attachments on the cleaner. That patent discloses means to permit the alternate operation of the high speed and low speed switches, but prevents the simultaneous operation of both switches.

The object of U.S. Pat. No. 3,319,282 may be defeated, however, if either the high speed or low speed switch is operated intentionally or inadvertently by finger pressure with an attachment off, thus permitting the operator to insert his or her fingers into the fan. With the rise of product liability, therefore, manufacturers are striving for more foolproof safety systems to be built into their products, and this invention provides a more foolproof arrangement as compared to the prior art devices.

SUMMARY OF THE INVENTION

This invention overcomes the foregoing prior art problems by providing a safety switch which is automatically disconnected to disable the vacuum cleaner before access may be had to the nozzle or accessory attaching means. Thus, before access may be had to the fan, the safety switch must be disconnected from the cleaning attachment.

This is accomplished by mounting the safety switch within the headlight shroud so that when the shroud is in its down or closed position, the safety switch cooperates with lugs on the particular cleaning attachment to drive the motor at either a high or low speed. In order to remove the attachment, the headlight shroud must be pivoted upwardly to gain access to the connecting lug for the attachment. However, when the headlight shroud is thus opened, the safety switch is disconnected from the attachment since it is attached to the shroud.

The safety switch itself comprises a housing having spaced electrical contacts along one of its walls. A shiftable contact bar establishes electrical connections between certain pairs of those contacts, and is normally biased to a position wherein electrical connections are not made between the pairs of contacts. The contact bar has cam surfaces at each end thereof which are adapted to be engaged by lugs which protrude from the attachments. When the contact bar is in its normally biased, first switch position, the motor is disconnected from an electrical circuit. When the contact bar is shifted by one of the lugs to a second contact position, an electrical connection is effected and the motor is run at a relatively low speed. If a lug moves the contact bar to a third switch position, the motor is caused to run at a relatively high speed.

Since the safety switch is mounted in the headlight shroud along with the headlight, wiring connections would normally be difficult to accomplish. However, this invention provides a wiring harness arrangement which facilitates assembly of the vacuum cleaner. There is provided a connector block having a wire carrying channel which plugs directly into the safety switch and which eliminates the possibility of improper wiring. The wires are carried by the channel to the rearward portion of the housing for ultimate connection to the motor and to the off-on switch of the cleaner.

DETAILED DESCRIPTION OF THE INVENTION

Figure 1:
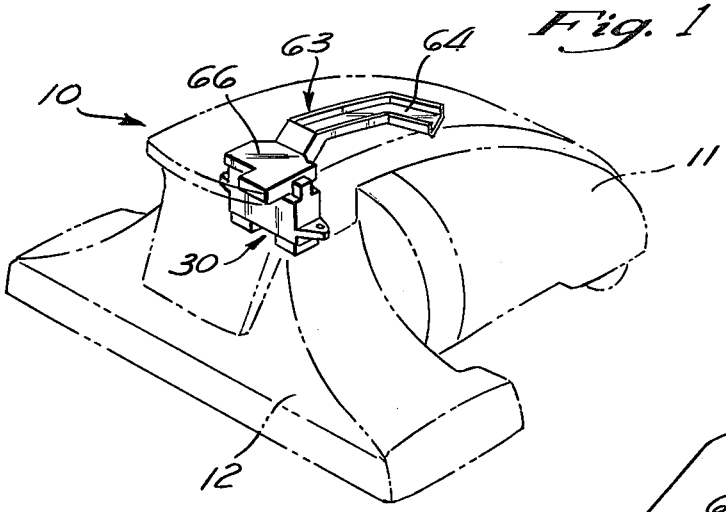
FIG. 1 is a perspective view of a vacuum cleaner housing and rug nozzle attachment showing the safety switch and wiring harness installed in the headlight shroud.

Referring now to the drawings, the rug contacting portion 10 of a vacuum cleaner is illustrated. The portion 10 includes a fan housing 11 which may be fitted with either a rug nozzle 12, as shown in FIG. 1, or, alternately, a tubular fitting 12A to which an off-the-floor cleaning hose (not shown) may be connected.

The housing 11 has a vertical front wall 13 provided with a central inlet opening 14. The housing includes a tangential outlet opening (not shown) which is connected to a dirt-collecting bag (not shown). A fan 15 is mounted in the housing on a shaft 16 and the shaft is driven by a motor 17. The motor 17 is mounted in the housing 11 with the fan shaft 16 projecting forwardly through the opening 14, and has a forward end portion 18 forming to provide a pulley for a belt 19. The carpet or rug cleaning nozzle 12 is removably attached to the fan casing 13, and is provided with a tubular portion 20 which receives the fan shaft 16 and which has an end portion 21 that fits within the opening 14. The nozzle has slotted lugs 22 on the underside of the tubular portion 20 and these lugs engage a horizontal pin 23 that is carried by the fan casing wall 13. A flange 24 is provided on the upper side of the nozzle 12, and the flange bears against the outer face of the front wall 13 and is locked in this position by a clamping member 25 to secure the nozzle to the fan casing.

Similarly, the fitting 12A is provided with a pair of lugs 26 on the underside and these lugs are intended to engage the horizontal pin 23 when the attachment 12A is applied to the fan casing. The attachment 12A also carries a flange **27*a* which is similar to the flange 24**.

Figure 2:
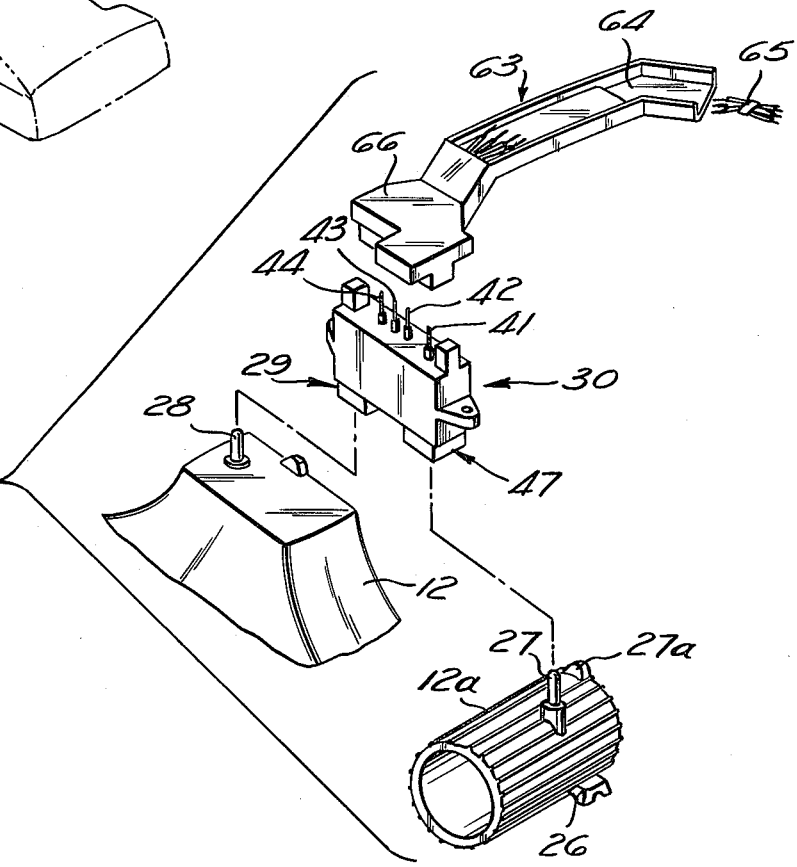
FIG. 2 is a fragmentary, exploded view of the safety switch, the wiring harness, and two different attachments which are adapted to be affixed to the motor housing.
Figure 7:
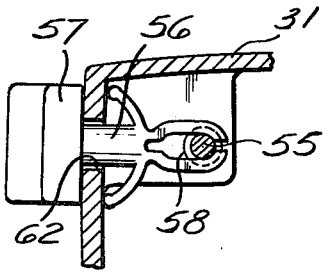
FIG. 7 is a cross sectional view, the plane of the section being indicated by the line 7—7 in FIG. 6.
Figures 3, 4, 5:
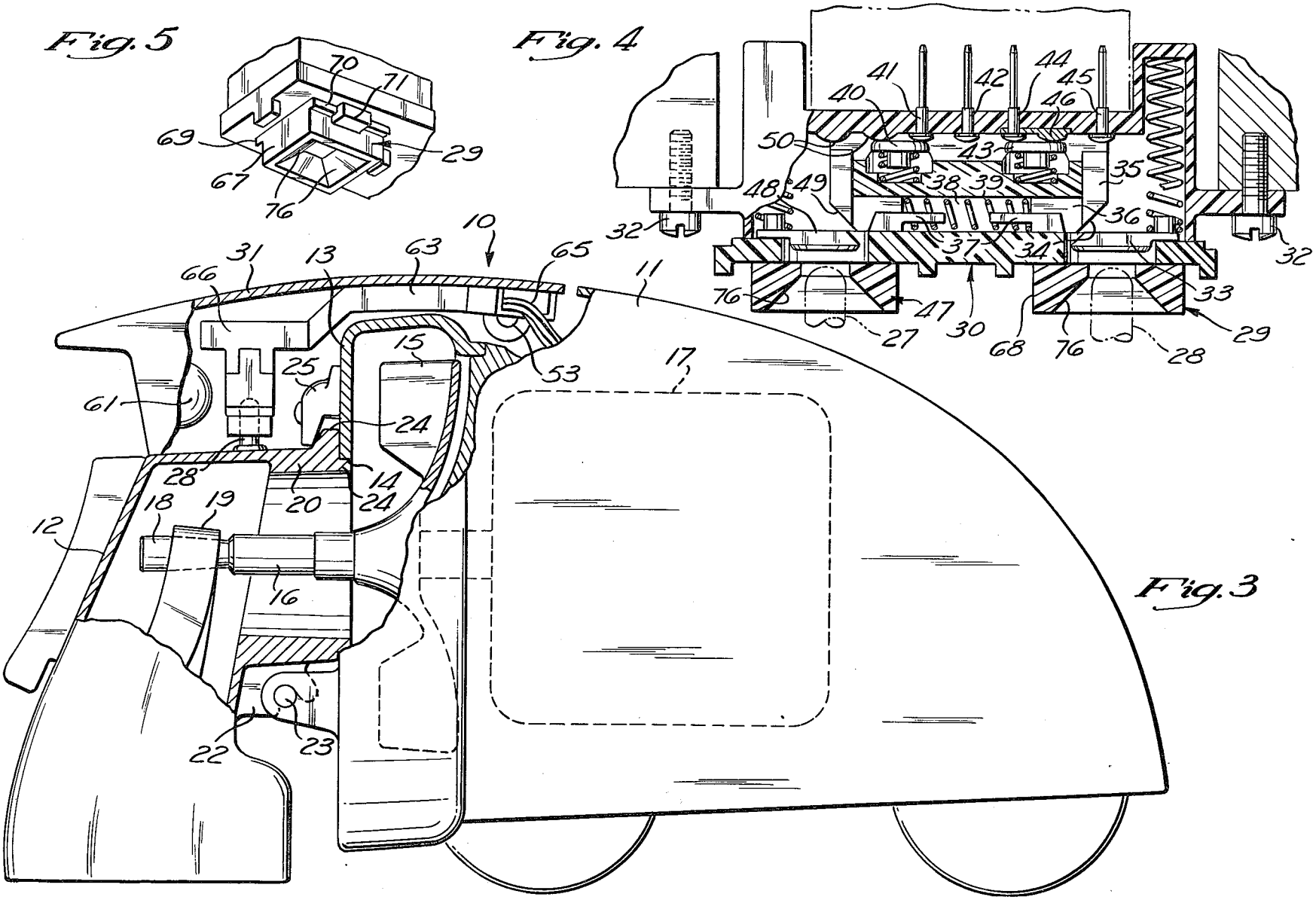
FIG. 3 is a side elevational view of the assembly illustrated in FIG. 1, with certain portions broken away to show details of construction.
FIG. 4 is an elevational view of the safety switch, partly in section, viewing the switch from the rear of the cleaner.
FIG. 5 is a fragmentary, perspective view of a portion of the safety switch showing one of the lug insertion sockets.
Figure 8:
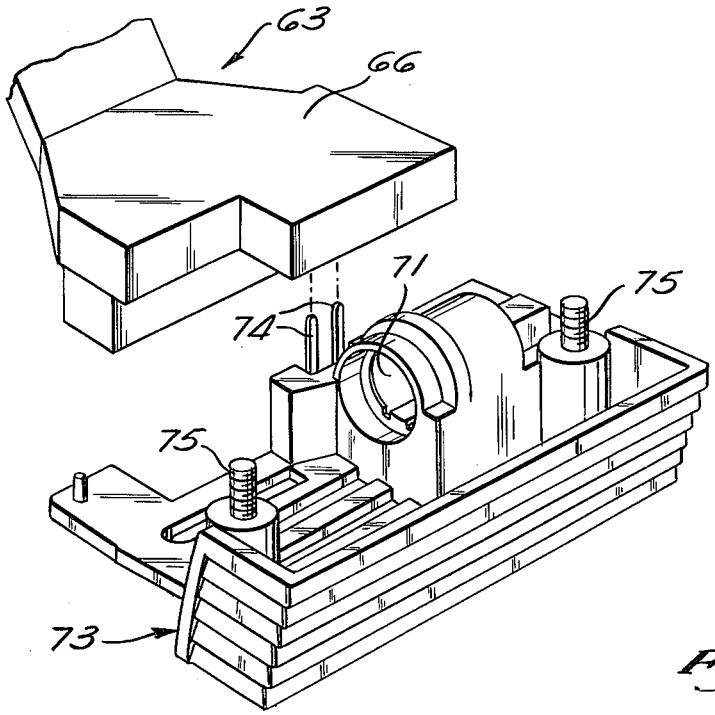
FIG. 8 is a perspective view of the bulb mounting assembly showing its relationship with the wiring harness assembly.

Referring particularly to FIGS. 2, 3, and 4, it may be seen that the rug nozzle 12 carries an offset insertion pin 27 which is adapted to be received in a socket 29 of a safety switch 30. The safety switch 30 is fixed to a headlamp shroud 31 by bolts 32 (FIG. 4). When the headlamp shroud 31 is in its closed position, as seen in FIG. 3, the pin 27 advances from its phantom outline position in FIG. 4 to strike a spring-biased dust cap 48, which in turn strikes a cam surface 49 on a shiftable contact bar 35. The contact bar 35 is provided with a slot 36 which receives a pair of guides and spring retainers 37. Mounted within a groove 38 is a spring 39 which normally retains the contact bar in the centered position illustrated in FIG. 4. In this position, and as will be further explained, power to the motor is interrupted even if the vacuum cleaner is plugged in and the off-on switch is turned to the "on" position.

If the attachment 12 is connected to the opening 14 in the fan casing 13, its pin 28 enters a socket 29 and strikes a spring-biased dust cover 33. The dust cover 33 engages a cam surface 34 to move the contact bar 35 to the left, as viewed in FIG. 4. In its thus-shifted position, the contact member 40 is moved to rest on a pair of ridges 50 so that the contact member 40 does not function to complete a circuit. However, the contact member 43 makes contact between the pins 42 and 44. With the contact bar in this position, the motor circuit is conditioned to operate the motor at a relatively low speed for on-the-floor cleaning operations.

If the attachment 12A is connected to the opening 14 in the fan casing 13, its pin 27 is inserted and when the contact bar is shifted to the right as viewed in FIG. 4, the spring-biased contact member 40 makes contact with a pair of contact pins 41 and 42, while a second spring-biased contact member 43 makes contact with contact pins 44 and 45. It should be noted that contact to the pin 44 is made via a contact pad 46 which is electrically connected to the pin 44. When the contact members 40 and 43 achieve this position, the motor circuit is conditioned to run the fan at a relatively high speed.

Figure 9:
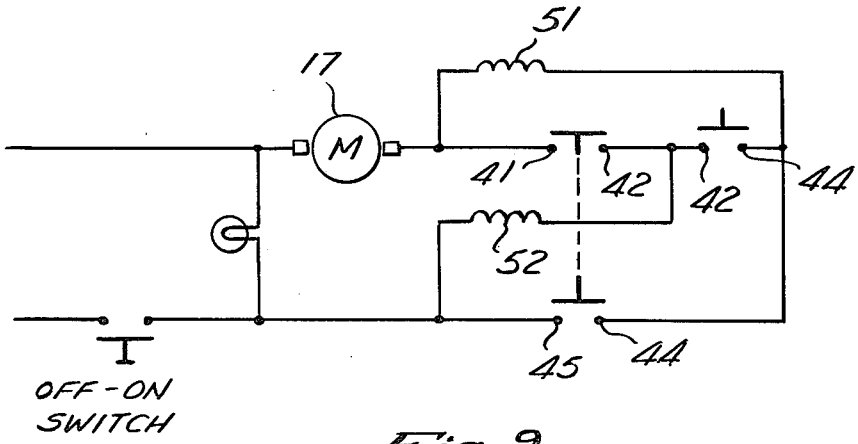
FIG. 9 is an electrical schematic representation of the switching arrangement of the apparatus.

The previously described switching operation is shown schematically in FIG. 9. Thus, if the contact bar 35 is shifted to the right, the contacts 41 and 42 are connected and the contacts 44 and 45 are connected to place field windings 51 and 52 of the motor 17 in parallel for high speed operations. If, on the other hand, the contact bar is shifted to the left, only the contacts 42 and 44 are closed to place the field windings in series for low motor speed cleaning operations.

Figure 6:
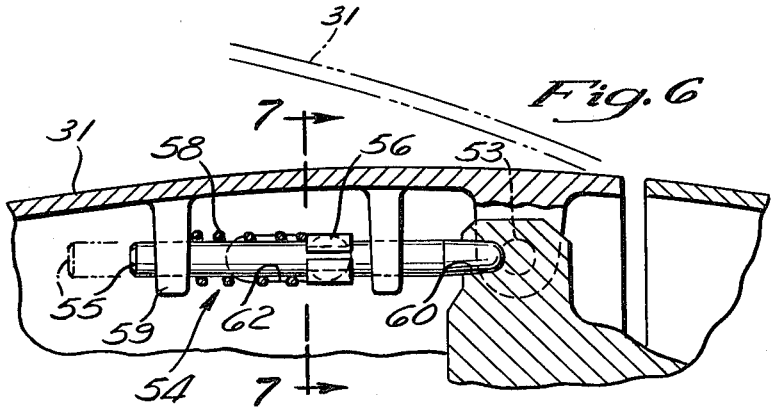
FIG. 6 is a fragmentary, sectional view of a portion of the headlight shroud showing a locking connection for the shroud.

As was previously indicated, the headlight shroud is pivotally connected to the housing 11 by a pivot pin 53 and is latched in that position by a latch pin assembly 54. The assembly 54 comprises a pin 55 carrying an actuating stem member 56, which in turn carries a release knob 57. The assembly is biased to the right, as viewed in FIG. 6, by a compression spring 58 which extends between a hanger 59 and the stem 56. One end of the pin 55 is received within a socket 60 provided in the housing 11. The headlight shroud may be released and raised to service the headlight bulb 61 by moving the knob 57 forwardly so that the pin is retracted and the stem 56 slides along a notch 62.

Electrical connections to the safety switch are made through a wiring harness assembly 63, which includes a trough portion 64 which carries the bundled wires 65 and a connector block section 66 in which the wires 65 terminate in right-angled electrical connectors which are adapted to mate with the pins 41–44. This arrangement ensures that the proper connections will be made and maintain the wires in an orderly fashion.

The bulb 61 is positioned within a socket 72 of a clear plastic molding 73 and the socket 72 is in electrical communication with a pair of prongs 74. The prongs 74 enter sockets (not shown) in the block section 66 of the harness assembly 63. The plastic molding which comprises means for mounting the bulb 61 is attached to the shroud 31 by a pair of threaded fasteners 75 so that, in order to change the bulb 61, the molding 73 must be removed from the shroud 31. This act also unplugs the prongs 74 from their receptacles so that there is no chance of electrical shock.

In order to account for manufacturing tolerances between the nozzle assembly and the safety switch, and to accommodate for any slight misalignment of the nozzle relative to the fan casing and safety switch, each socket 29 and 47 has an outlet mouth 67 and 68 which is adapted to move relative to the main body of the switch. Thus, each outlet mouth is provided with flanges 69 and 70 which are received in guides 71. If a pin 28 or 27 strikes a sloped wall 76, the mouth will simply move to permit entry of the pin in question.

It should be evident that this disclosure is by way of example and that various changes may be made by adding, modifying or eliminating details without departing from the fair scope of the teaching contained in this disclosure. The invention is therefore not limited to particular details of this disclosure except to the extent that the following claims are necessarily so limited.

What is claimed is:

1. In a suction cleaner having a motor, a body portion housing said motor, and interengageable attachments adapted to be attached to the body portion for cleaning operations requiring different motor speeds, the improvement comprising a safety switch, a headlight shroud pivotally attached to said body portion, said safety switch being fixed to said headlight shroud, attaching means on each attachment interengaging with attaching means on said body portion, said attaching means being covered by the headlight shroud in a first closed position and being exposed by said shroud when said shroud is pivoted to a second open position, said safety switch having a first switch position adapted to disconnect said motor from an electrical circuit, having a second switch position adapted to cause said motor to run at a relatively slow speed, and having a third switch position adapted to cause said motor to run at a relatively high speed, each attachment having means to actuate said switch means to permit the motor to run only when the shroud is closed and the attachment is in place and including means to move said switch to either said second or third switch positions.

2. A suction cleaner according to claim 1, wherein said motor has field windings, wherein said second switch position places said field windings in a series circuit, and wherein said third switch position places said field windings in a parallel circuit.

3. A suction cleaner according to claim 1, wherein said safety switch includes a housing, spaced electrical contacts along one wall of the housing, a shiftable contact bar adapted to establish electrical connections between certain pairs of said contacts, said contact bar being normally biased to a position wherein electrical connections are not made between said pairs of contacts, first and second cam surfaces on said contact bar adapted to be engaged by said moving means on each attachment to move said contact bar to a position wherein an electrical connection is made between certain of the contacts to constitute said second switch position or to move said contact bar to a position wherein an electrical connection is made between certain of the contacts to constitute said third switch position.

4. A suction cleaner according to claim 3, wherein said moving means on each attachment comprises a pin projecting from each attachment.

5. A suction cleaner according to claim 4, wherein said housing is provided with a pair of spaced openings, each of said openings being located in alignment with one of said first and second cam surfaces so that said one of said pins may enter one of said openings to move said contact bar to either of said positions.

6. In a suction cleaner having a motor, a body portion housing said motor, and interchangeable attachments adapted to be attached to said body portion for cleaning operations requiring different motor speeds, the improvement comprising a safety switch, a headlight shroud pivotally attached to said body portion, said safety switch being fixed to said headlight shroud, attaching means on each attachment interengaging with attaching means on said body portion, said attaching means being covered by the headlight shroud in a first closed position and being exposed by said shroud when said shroud is pivoted to a second open position, said safety switch disconnecting said motor from an electrical circuit when said shroud is opened.

7. A suction cleaner according to claim 6, including a wiring harness in said housing for said switch, said wiring harness including a channel carrying a plurality of wires to said switch, said channel terminating in a terminal block, said terminal block carrying a plurality of connectors adapted to mate with a plurality of contacts in said safety switch.

8. In a suction cleaner having a motor, a body portion housing said motor, and interchangeable attachments adapted to be attached to said body portion for cleaning operations, the improvement comprising a headlight assembly including a bulb mounted on the front of said housing, said assembly including a headlight shroud pivotally connected to said body portion, means comprising a bulb mounting means removably fixed to said shroud, said buld mounting means including prong means establishing an electrical connection with said bulb, a wiring harness in said housing for said bulb, said wiring harness including a channel carrying a plurality of wires to said bulb, said channel terminating in a terminal block, said terminal block carrying a plurality of connectors adapted to mate with said prongs when said bulb mounting means is removably fixed to said shroud, whereby said bulb mounting means is electrically disconnected from said terminal block when said bulb mounting means is removed from said shroud to change a bulb.

* * * * *